United States Patent [19]

Driesenga

[11] 4,056,864

[45] Nov. 8, 1977

[54] BACK AND BAIL ASSEMBLY

[75] Inventor: Edwin J. Driesenga, Zeeland, Mich.

[73] Assignee: Keeler Corporation, Grand Rapids, Mich.

[21] Appl. No.: 625,830

[22] Filed: Oct. 28, 1975

[51] Int. Cl.[2] ..... A47B 95/02

[52] U.S. Cl. ..... 16/126; 190/58 R

[58] Field of Search ..... 16/126; 190/39, 57, 190/58 R, 58 A

[56] References Cited

U.S. PATENT DOCUMENTS

| | | | |
|---|---|---|---|
| 93,678 | 8/1869 | Churchill | 16/126 |
| 230,572 | 7/1880 | Reichenbach | 190/58 R |
| 1,819,611 | 8/1931 | Martin | 16/126 |
| 2,332,765 | 10/1943 | Thiele | 190/58 R |
| 2,652,909 | 9/1953 | Knell | 16/126 X |
| 3,248,750 | 5/1966 | Black | 16/126 |

FOREIGN PATENT DOCUMENTS

| | | | |
|---|---|---|---|
| 873,722 | 7/1961 | United Kingdom | 190/57 |

*Primary Examiner*—Andrew V. Kundrat

*Attorney, Agent, or Firm*—Price, Heneveld, Huizenga & Cooper

[57] ABSTRACT

The specification discloses a furniture pull comprising a back and bail assembly adapted for ease of installation. Each of two legs of the bail or handle includes a pin or projection extending laterally to only one side and a cut-away portion formed by a surface inclined to the direction of extension of said pin on the opposite side of the leg. A back member is provided for each leg and includes opposing wall surfaces, one of which includes a recess for the leg pin. For assembly, the pin is inserted in the wall recess and the leg or back member rotated to seat the leg between the walls while the cut-away portion provided by the inclined surface provides clearance room for such rotation. Each leg appears to be pinned to both its adjacent wall surfaces while, in fact, it is pivotally secured to only one.

17 Claims, 10 Drawing Figures

BACK AND BAIL ASSEMBLY

BACKGROUND OF THE INVENTION

This invention relates to furniture hardware and, more particularly, to a back and bail assembly for use as a furniture pull which is uniquely adapted for ease of installation on furniture.

It is common to provide furniture hardware-namely, pulls for drawers, cabinet doors, and the like, with handles having at least a pair of legs and means for pivotally securing each of the legs to a furniture component. Typically, the securing means for the handle include openings for receiving studs or projections from the handle so that the handle may be pivoted therearound. The securing structure including the openings may be such that it extends either on one or both sides of each leg of the handle such that the handle is pivotally secured on one or both sides of each leg.

A particular problem has been encountered in securing such furniture pull assemblies to furniture. Typically, many pieces are required to engage the bail or handle, which pieces must thereafter be secured to the furniture. The problem is especially pronounced when each leg of the handle is pivotally secured to support means included on either side of each leg of the handle. In such cases, it is necessary to provide means for slipping the attachment means over the pins extending on either side of each leg of the handle or separately pinning the legs through the attachment means. Generally then, it has been difficult to provide a back and bail assembly for furniture pulls which is both easily assembled to the furniture and yet provides support means on either side of each leg of the handle.

The present invention provides a unique solution to the above problem in that the assembly avoids the necessity for complex structure previously necessary to pivotally secure a bail or handle on either side of each leg thereof. The invention provides the impression of support on either side of each leg and yet, in fact, requires only a single pin extending to only one side of each leg to provide such pivotal support. The invention is extremely simple to assemble on furniture. Removal of the assembly from the furniture is prevented unless one of the back members for pivotally attaching the bail is removed from the furniture.

SUMMARY OF THE INVENTION

Accordingly, the present invention provides a back and bail assembly for furniture pulls and the like comprising a bail or handle having a pair of legs and a pair of back members for pivotally securing the bail to furniture. Each back member secures one bail leg to the furniture. The assembly is unique in that each leg of the bail or handle includes only a single projection or pin extending from only one side of each leg and cut-away area, preferably formed by an inclined surface, on an area of the leg opposite to the projection or pin.

The back members include projections or wall surfaces on each side of the legs and are spaced slightly farther apart than the legs. At least one of the wall surfaces includes a recess for receiving the pin while the cut-away portion formed by the inclined surface allows the leg and back member to be rotated with respect to one another such that the leg is seated between the wall surfaces or projections on the back member.

The result is a back and bail assembly which provides the aesthetic appearance of each leg of the handle or bail being pivotally secured on either side thereof while, in fact, each leg is pivotally secured by a pin extending to only one side. Moreover, the handle or bail and the two back members are quickly and simply assembled by inserting the pin in the recess in one of the wall surfaces and rotating the leg or back member until the leg seats between the wall surfaces. The only additional hardware necessary for the assembly is a screw for each back member projected from or through the furniture to threadedly secure the back member to the furniture.

In another aspect of the invention, recesses may be included in both of the opposing wall surfaces such that it is necessary to manufacture only a single type of back member for use with the legs of the bail or handle. Such legs may have a projection or pin extending to either side and yet still be received in the single type of back member.

In yet another aspect of the invention, alternative means are provided for attaching the back member, and thus the back and bail assembly, to furniture such that the back members are prevented from rotating on the furniture.

These and other objects, advantages, purposes, and features of the invention will become more apparent from a study of the following description taken in conjunction with the drawings.

DESCRIPTION OF THE PREFERRED EMBODIMENT

Figure 1:
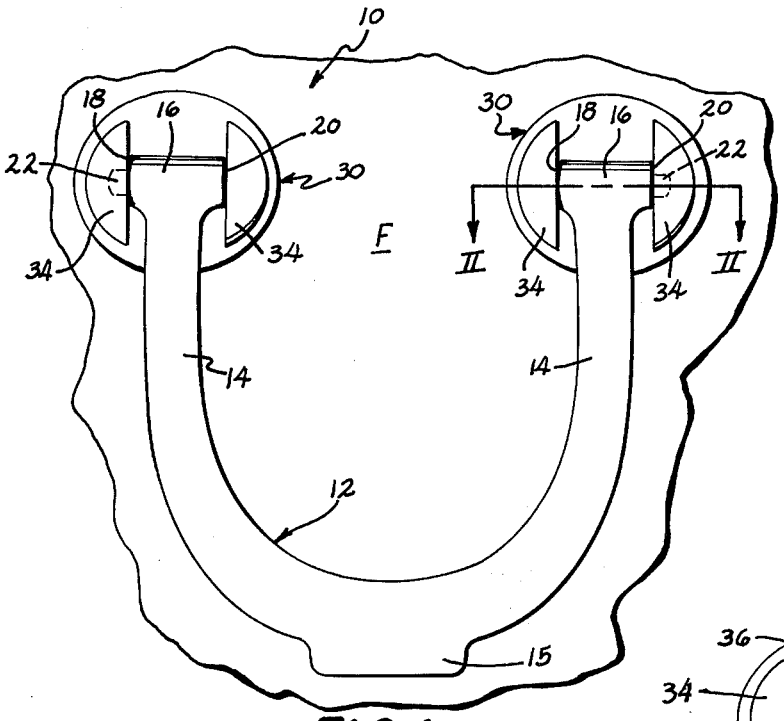
FIG. 1 is a front elevation of the back and bail assembly of the present invention.
Figure 3:
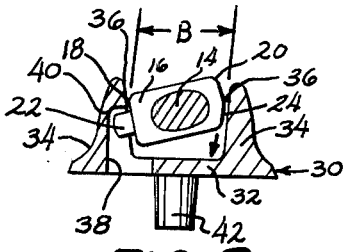
FIG. 3 is a sectional view of the embodiment of the back member of FIGS. 1 and 2 being assembled to a leg of the bail or handle.
Figure 2:
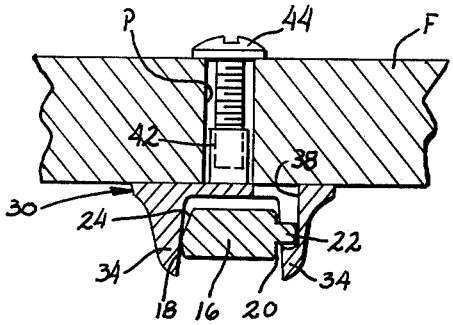
FIG. 2 is a sectional view of one of the back members and one of the legs of the bail taken along plane II—II of FIG. 1.
Figure 4:
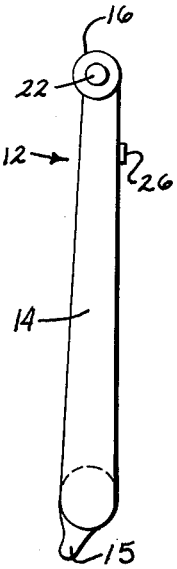
FIG. 4 is a side elevation of the bail or handle.

Referring now to the drawings in greater detail, FIGS. 1-3 illustrate one embodiment 10 of the back and bail assembly of the present invention including the various portions thereof. The bail or handle portion 12 has a generally U-shaped configuration including generally parallel leg members 14 merging into enlarged heads 16 at the ends of the legs. Each head portion 16 is generally cylindrical having a generally rectangular cross-sectional shape when viewed from the front (FIG. 1) and a circular cross-sectional shape when viewed from the side (FIG. 4). Head portion 16 includes left and right end 18 and 20 (FIG. 1). On the outer end of each head portion 16--namely, the left end 18 on left leg 14, and on the right end 20 on the right leg as shown in FIG. 1, are included cylindrical pins or stud projections 22 extending to only one side of the leg, formed integrally with head 16, and extending beyond the respective end surfaces. Studs 22 generally coaxial with the head portion cylinders 16 and provide a pivot axis for the bail or handle 12 which is rotated therearound by grasping a flange 15 at the bottom of the bail when the bail is assembled with the back members. As shown generally in FIG. 4, legs 14 lie generally in the same plane while the axes of cylindrical pins or stud projections 22 likewise lie in the same plane. As will be seen in FIG. 1, studs or pins 22 extend in opposite directions to either lateral side of the bail or handle but only one pin is included on each leg. Alternatively, pins 22 may extend toward one another, one from the inside of each leg. Further, one pin 22 could be formed to extend from the inside of one leg while the other pin extends from the outside of the other leg. In any event, only a single pin need extend from each leg.

On the end of each head portion 16 which is opposite from the end from which the pins or stud projections 22 extend, is a cut-away portion or area allowing the respective leg to be pivoted into a position between the supports of a back member. In the assembly embodiment shown in FIGS. 1–3, the cut-away portion is formed on each head 16 by an inclined surface 24 recessed from the normal or regular outline of head 16 which provides a bevel across the bottom corner on the end opposite the pin or stud 22--namely, end 20 for the left leg and end 18 for the right leg (FIG. 1). Surface 24 is inclined at an angle to the axis of cylindrical pin 22.

As is best seen in FIG. 1, the bail or handle 12 is pivotally secured to a furniture member F by means of a pair of back members 30, one back member being provided for each leg 14. Each back member includes a generally planar base portion 32. Projecting outwardly from one side of the base 32, at spaced positions adjacent either end of the base, are a a pair of bail supports or flanges 34. The inside wall surfaces 36 of the supports or flanges 34 are generally planar, extend generally perpendicular to base 32, and oppose one another to define a pocket, recess, or slot therebetween for receiving the head 16 of one of the legs of the bail 12.

Figure 5:
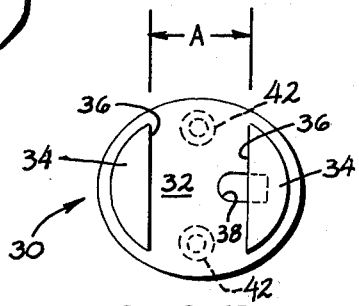
FIG. 5 is a front elevation of the back member shown in FIGS. 1-3.

In order to receive the pin or stud projection 22 from one of the head portions, at least one of the wall surfaces 36 of back member 30 includes an elongated slot or recess 38 which extends outwardly along the wall surface away from base 32 and ends with a closed end 40 at a distance spaced from the base 32. As seen in FIGS. 2, 3, and 5, recess 38 extends through the base and opens to the back side of the base and also extends into the area of the base between the wall surfaces 36 and is therefore generally L-shaped in overall configuration. When assembled, the side surfaces of the pin or stud projections 22 abut against the ends 40 of the recesses 38 and pivot thereagainst such that the bail is pivotally secured to the back members.

In the preferred embodiment, the bail supports or flanges 34 are spaced a predetermined distance apart indicated by distance A in FIG. 5. The length of the cylindrical head portions 16 on the ends of legs 14 or bail 12 are predetermined to be slightly shorter than the width A between the wall surfaces 36 as shown in FIGS. 1 and 2. The pins or stud projections 22 project beyond the ends of the heads and beyond the surface of the wall 36 including recess 38 into the recess which has a depth sufficient to receive the pin without binding. The greatest distance across the diagonal of the head portion, denoted by dimension B in FIG. 3, is predetermined to be slightly less than the distance A between the wall surfaces 36. The greatest distance across the head portion is from one of the corners of the end from which the stud projection 22 extends to the inclined surface 24 forming the cut-away portion on the opposite diagonal corner adjacent the bottom surface of the bail. Thus, head portions 16 can be rotated into place while the cut-away portion provided by inclined surface 24 provides clearance room for such rotation as shown in FIG. 3.

In embodiment 30 of the back member, a pair of aligned socket members 42 are integrally cast on the rear surface of base 32 oposite from the surface from which the bail supports or flanges 34 extend. Each socket is generally cylindrical but slightly tapered to facilitate removal from its die and includes a bore therein which is threaded to receive a threaded fastener or screw 44 as shown in FIG. 2. The sockets 42, which are spaced apart at the rear of the back member, are inserted into bores or pilot holes P through aperture panel F (FIG. 2) and a threaded fastener or screw 44 is inserted from the opposite end of the bore P for receipt in the socket to attach the back member, and thus the back and bail assembly, to the furniture. The spaced location of the socket members 42 prevents rotation or turning of the back member when installed on the furniture.

Figure 6:
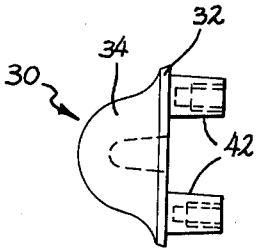
FIG. 6 is a side elevation of the back member shown in FIGS. 1-3 and 5.

Preferably, bail or handle 12 and back members 30 are die cast from zinc or a similar metal. Casting allows the various projections to be easily and inexpensively formed without time-consuming and expensive machining and milling operations. In order to facilitate removal from the die, the wall surfaces 36 diverge slightly outwardly from base 32, as shown in FIG. 3, while the sides of sockets 42 taper slightly toward one another (FIGS. 3 and 6). Also, recesses 38 extend through and open to the back of base 32 allowing removal of the core used to form the recess when the back member is removed from the die.

Referring now to FIGS. 7–10, another embodiment 50 of the back members for pivotally securing the bail or handle 12 to a furniture component are shown. Back members 50 are similar to back members 30 but are die cast from zinc with a shell-like exterior including the various projections and protrusions. Back members 50 include a base portion 52 and bail supports or flanges 54 extending outwardly away from the base portion. Supports or flanges 54 are integrally connected by a joining flange or wall section 56 extending between like ends of the projections 54. Projections 54 and wall section 56 form a socket-like recess for receipt of the head portion 16 of one of the legs of the bail or handle 12 intermediate generally opposing, planar wall surfaces 58 and immediately adjacent transverse wall section 60. Wall surfaces 58 and 60 are generally perpendicular to base 52. Each of the projections 54 includes an aperture 62 extending outwardly away from base portion 52 having a closed end 64. These apertures correspond to recess 38 in embodiment 30 of the back member and allow the single back member 50 to be used without being inverted with either leg of the bail or handle 12 regardless of whether the pin or stud projection 22 is on the inside or outside of the leg. Such apertures extend through only the walls 58 but not the outer walls of the flanges or bail supports 54.

Figure 9:
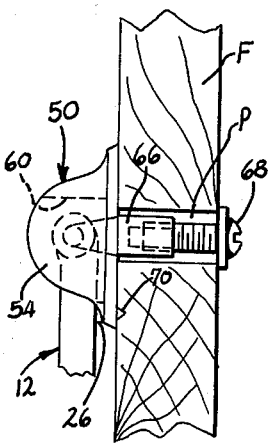
FIG. 9 is a sectional side elevation of the back member shown in FIGS. 7 and 8 secured to furniture without the plate member illustrated in FIGS. 7 and 8 and including the bail or handle secured therein.
Figure 7:
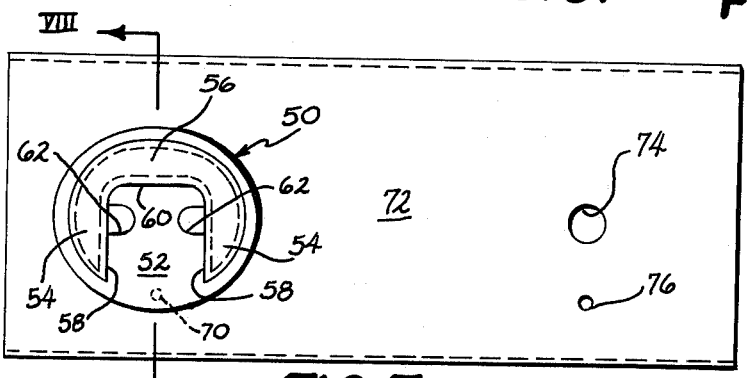
FIG. 7 is a front elevation of an attachment plate and another embodiment of the back member for securing a bail or handle to furniture.

On the side of base portion 52, opposite the side from which flanges 54 project, is formed a single socket 66 including a threaded bore for receipt of a threaded fastener 68 inserted through a bore P in a furniture component F as shown in FIG. 9. In order to prevent rotation or turning of the back member 50, a tapered, sharp projection 70 is provided at a spaced location from socket 66 for embedding in the surface of the furniture component F.

Figure 8:
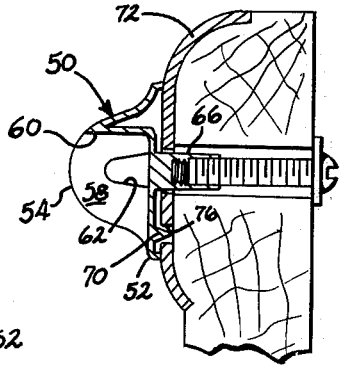
FIG. 8 is a sectional view taken along plane VIII—VIII of FIG. 7.
Figure 10:
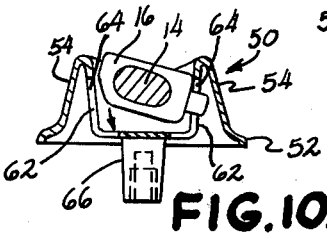
FIG. 10 is a sectional view of the back member and bail shown in FIG. 9 during assembly.

If it is desired to avoid marring or scratching of the surface of the furniture component, or to provide a more decorative base for mounting the back and bail assembly, a separate plate 72 may be mounted behind the back members 50. Such plate may be either flat or curved in cross section to conform to the contour of the furniture component F (FIG. 8). Plates 72 includes pairs of spaced, aligned apertures 74 and small detents or apertures 76 for receipt of socket members 66 and projections 70, respectively, to allow attachment of the back members 50 to the furniture components.

For assembly of the bail or handle 12 with a pair of back members of either embodiment 30 or 50, one of the back members 30 or 50 is attached to the furniture component as shown in FIGS. 2, 8, or 9. Thereafter, the head portion 16 of one leg 14 of bail or handle 12 is inserted between flanges 34 or 54 of the secured back member with the pin or stud projection 22 being inserted in recess 38 or aperture 62 at an angle to the wall surface 36 or 58. Thereafter, the second back member 30 or 50 is likewise assembled to the opposite leg of the bail or handle 12 by inserting pin or stud projection 22 into the recess 38 or aperture 62 in the outside flange 34 of another like back member. The unattached back member is then rotated with respect to its leg such that the head portion 16 is seated between flanges 34 or 54. The entire bail is then rotated to seat the head portion 16 between the flanges 34 or 54 of the back member which is already secured to the furniture component. Such rotation of the entire bail or handle allows the socket members 42, 66 and projections 70 to be inserted in the furniture component and the fastening screws 44 or 68 threadedly secured therewith to complete the assembly. The cut-away portions defined by inclined surfaces 24 allow such assembly rotation only when bail or handle 12 is subtantially parallel to bases 32, 52 but not when the bail is perpendicular thereto. Thus, the bail will not pull away from the back members when pivoted outwardly from the furniture to open a drawer, cabinet door, or the like on which the assembly is mounted.

It will be understood that assembly of both the back members to the individual legs of the bail or handle may also be accomplished before attachment of either back member to the furniture component. Alternatively, one of the back members may be first secured to the furniture component or furniture component plus a plate 72 after which the remaining back member and bail are assembled to it. In any event, the cut-away portion formed by inclined surface 24 allows the rotational movement necessary to assemble the back members and bail into the seated position in which the pin or stud projections 22 extend generally transverse to the wall surfaces 36 or 58 and pivotaly engage the closed ends 40 or 64 of recesses 38 or apertures 62. When seated, head portions 16 are spaced slightly away from bases 32, 52 of the back members.

A small projection 26 may be cast integrally on the rear surface of one or both of legs 14 of bail or handle 12 at a position spaced slightly away from the head portion 16 (FIGS. 4 and 9). Such projection 26 spaces the bail away from the furniture component to which the bail and back assembly is secured by engaging the base portion 32 or 52 of the back members thereby preventing the bail from marring or scratching the furniture surface.

Accordingly, the present invention provides a back and bail assembly which gives the impression of each leg of the bail or handle being secured by a pin connection to supports on both sides of each leg. However, the assembly is accomplished with but a single pin or stud projection extending laterally from only one side of each leg thereby greatly simplifying the assembly procedure and allowing such assembly from the front surface of the furniture. The cutaway portions on the surfaces of the leg opposite the pin or stud projections allow rotation of the legs into position between the bail supports or flanges to seat the legs in their assembled positions in a quick and simple manner once the pin or stud projection has been inserted into the recess or aperture provided therefor in the back member. Removal of the bail or handle is prevented unless one of the back members is removed from the furniture allowing rotational movement of the bail transverse to the surface of the furniture.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows.

1. A furniture hardware assembly comprising a handle and a pair of back members for pivotally attaching said handle on furniture; each of said back members including attachment means for attaching said back member to furniture and a pair of spaced, generally opposing wall surfaces, at least one of said wall surfaces including a recess closed at one end; said handle including a pair of legs, each leg including projection means extending from only one side thereof for insertion in said recess of one of said back members; said recess being of sufficient size to receive only said projection means but not the remainder of either side of said leg; means on the opposite side of said leg from said projection means for rotating said leg into said back member without contact between said opposite side of said leg and the other of said wall surfaces opposite said wall surface including said recess, said means including a cut-away portion on the opposite side of each of said legs from said projection means providing the clearance room for rotating each of said legs and its respective back member with respect to one another without such contact whereby said leg is positioned between said wall surfaces after said projection means is inserted in said recess; said opposite side of said leg being in adjacent and abutting relationship to said other wall surface without being pivotally joined to or received in any portion of said other wall surface; each of said legs being retained in its respective back member after insertion by engagement between said projection means on only one side of said leg and said closed end of said recess although each leg appears to be pivotally connected to each wall surface.

2. The furniture hardware assembly of claim 1 wherein said legs each include a head on the end thereof, each head having opposing end surfaces; said projection means including a cylindrical pin extending outwardly from one of said head end surfaces; said cut-away portion being defined by an inclined surface formed at an angle to the axis of said cylindrical pin on the other of said head end surfaces.

3. The furniture hardware assembly of claim 1 wherein said projection means on each leg extend outwardly away from the other leg.

4. The furniture hardware assembly of claim 1 wherein said back members each include a base having opposite sides and a pair of spaced, opposing flanges extending outwardly from one side of said base; said attachment means being located on the opposite side of said base; said wall surfaces being formed on the inside surfaces of said flanges such that they generally oppose one another; said recess including a slot extending outwardly along one of said wall surfaces away from said base, said slot having a closed end spaced outwardly from said base.

5. The furniture hardware assembly of claim 4 wherein said slot extends through said base and opens to said opposite side of said base.

6. The furniture hardware assembly of claim 4 wherein said slot extends continuously into the portion of said base between said flanges.

7. The furniture hardware assembly of claim 4 wherein the other of said pair of flanges also includes a slot extending outwardly along the wall surface thereof, away from said base, and having a closed end spaced outwardly from said base whereby said back member having said two slots may be used with either leg of said handle regardless of the side of the leg from which said projection means extends.

8. The furniture hardware assembly of claim 4 wherein said attachment means include a pair of sockets on said opposite side of said base for separate insertion into the furniture, each socket adapted to receive a separate securing screw from said furniture; said pair of sockets preventing rotation of said back member on said furniture.

9. The furniture hardware assembly of claim 4 wherein said spaced flanges are joined by a continuous wall section extending between like ends of said flanges to form a large recess closed at one end on the front of said back members for receipt of the ends of said legs on said handle therein.

10. The furniture hardware assembly of claim 4 including a projection on the rear of at least one of said legs of said handle for engagement with said base to space said handle away from the furniture when mounted and in its rest position.

11. The furniture hardware assembly of claim 1 wherein said attachment means on said back members include spaced projections on the back sides of said members for separate engagement with furniture to prevent said back members from rotating on said furniture.

12. The furniture hardware assembly of claim 1 wherein said wall surfaces are spaced a predetermined distance apart generally at the position of said recss; said leg, at the position of said projection means, having a width slightly less than said predetermined distance; said projection means extending beyond said width of said leg a distance sufficient to project into said recess.

13. The furniture hardware assembly of claim 12 wherein each of said legs includes a head at its end, said head having two opposing ends, said projection means extending outwardly from a first end of said head; said cut-away portion being defined by an inclined surface located on the second end of said head; the maximum distance from any portion of said first end to said inclined surface being slightly less than said predetermined distance between said wall surfaces such that without said cutaway portions said heads of said legs could not be inserted between said spaced wall surfaces.

14. A furniture hardware assembly comprising a handle and a pair of back members for pivotally attaching said handle on furniture; each of said back members including attachment means for attaching said back member to furniture and a pair of spaced, generally opposing wall surfaces, at least one of said wall surfaces including a recess closed at one end; said handle including a pair of legs, each leg including projection means extending from one side thereof for insertion in said recess of one of said back members and means on the opposite side of said leg from said projection means for rotating said leg into said back member without contact between said opposite side of said leg and the other of said wall surfaces opposite said wall surface including said recess, said means including a cut-away portion on the opposite side of each of said legs from said projection means providing the clearance room for rotating each of said legs and its respective back member with respect to one another without such contact to position said leg between said wall surfaces after said projection means is inserted in said recess, each of said legs being retained in its respective back member after insertion by engagement between said projection means on one side of said leg and said closed end of said recess; said back members each including a base having opposite sides and a pair of spaced, opposing flanges extending outwardly from one side of said base; said attachment means being located on the opposite side of said base; said wall surfaces being formed on the inside surfaces of said flanges such that they generally oppose one another; said recess including a slot extending outwardly along one of said wall surfaces away from said base, said slot having a closed end spaced outwardly from said base; said attachment means including a single socket on said opposite side of said base for insertion into furniture, said socket adapted to receive a securing screw from said furniture, and a sharp projection spaced from said socket on said opposite side of said base for engaging said furniture to prevent rotation of said back member.

15. A furniture hardware assembly comprising a handle and a pair of back members for pivotally attaching said handle on furniture; each of said back members including attachment means for attaching said back member to furniture and a pair of spaced, generally opposing wall surfaces, at least one pair of said wall surfaces including a recess closed at one end; said handle including a pair of legs, each leg including projection means extending from one side thereof for insertion by said recess of one of said back members and cut-away portion on the opposite side of said leg from said projection means providing clearance room for rotating said leg and back member with respect to one another to position said leg between said wall surfaces after said projection means is inserted in said recess; said back members each including a base having opposite sides and a pair of spaced, opposing flanges extending outwardly from one side of said base; said attachment means being located on the opposite side of said base; said wall surfaces being formed on the inside surfaces of said flanges such that they generally oppose one another; said recess including a slot extending outwardly along one of said wall surfaces away from said base, said slot having a closed end spaced outwardly from said base; said attachment means including a single socket on said opposite side of said base for insertion into furniture, said socket adapted to receive a securing screw from said furniture, and a sharp projection spaced from said socket on said opposite sid of said base for engaging said furniture to prevent rotation of said back member; said assembly also including a plate behind said back member, said plate including a first aperture for receiving said socket and a detent aligned with said sharp projection for receipt thereof.

16. A back and bail assembly for furniture pulls and the like comprising a bail and a pair of back members for pivotally securing said bail to furniture; said bail including a pair of legs, each leg including an end portion having a predetermined width and projection means extending laterally in one direction from only one side of said end portion beyond said predetermined width for pivotally engaging one of said back members; each of said back members including generally opposing, wall surfaces for receiving one of said end portions of one of said legs therebetween, said wall surfaces being spaced apart in at least one area more than said predetermined width but less than said width plus the length of said projection means; at least one of said spaced wall surfaces including a recess for receiving and pivotally retaining said projection means, said recess having a closed end, opening toward the opposing wall surface, and a size sufficient to receive only said projecting means but not the remainder of either side of said end portion; means on each of said legs for rotating said legs into their respective back members without contact between the side of said leg opposite said projection means and the other of said wall surfaces opposite said wall surface including said recess, said means including an inclined surface inclined at an angle to the direction of extension of said projection means on the side of said end portion opposite said projection means; said projection means being inserted into said recess at an angle to said one wall surface while said leg and back member are rotated with respect to one another such that said inclined surface clears said opposing wall surface and said leg end portion seats between said wall surfaces; said opposite side of said leg being in adjaent and abutting relationship to said other wall surface without being pivotally joined to or received in any portion of said other wall surface; each of said legs being retained in its respective back member after insertion by engagement between said projection means on only one side of said leg and said closed end of said recess although each leg appears to be pivotally connected to each wall surface.

17. A back and bail assembly for furniture pulls and the like including a bail and a pair of back members; said bail having a pair of legs, each leg including engagement means for pivotally attaching only one side of the leg to one of said back members; said back members for each including attachment means for attaching said back member to furniture and a pair of spaced, opposing walls for receiving therebetween said engagement means of one leg of said bail; each of said engagement means including a pin extending in a direction to only one side of said respective leg and generally transverse to at least one of said spaced walls when assembled with said back member; at least one of said spaced walls of said back member including a recess deep enough and of sufficient width and length to receive said pin from one of said legs but not the remainder of either side of said leg; means on each of said legs for rotating said legs into their respective back members without contact between the side of said leg opposite said projection means and the other of said walls opposite said wall including said recess, said means including an inclined surface generally on the side of said respective leg opposite said pin and inclined to the direction of extension of said pin; said bail being pivotally secured to each of said back members by inserting the pin from one leg in said recess in said one spaced wall with said pin at an angle to said wall and rotating said leg with respect to said back member or vice versa such that said inclined surface clears said other spaced wall and said leg rests transverse to said walls; said opposite side of said leg being in adjacent and abutting relationship to said other wall without being pivotally joined to or received in any portion of said other wall; each of said legs being retained in its respective back member after insertion by engagement between said pin on only one side of said leg and an end of said recess whereby said pin on only one side of each leg retains said bail in each of said back members although each leg appears to be pivotally connected to each wall.

* * * * *

UNITED STATES PATENT AND TRADEMARK OFFICE

CERTIFICATE OF CORRECTION

PATENT NO. : 4,056,864

DATED : November 8, 1977

INVENTOR(S) : EDWIN J. DRIESENGA

It is certified that error appears in the above-identified patent and that said Letters Patent are hereby corrected as shown below:

Column 2, Line 67,

"end" , first occurrence, should read -- ends --.

Column 3, Line 5,

"22 generally" should be --22 are generally--.

Column 4, Line 15,

"oposite" should be --opposite--.

Column 5, Line 63,

"pivotaly" should be --pivotally--.

Column 10, Line 1,

"adjaent" should be --adjacent--.

Column 10, Line 14,

"members for each" should be --members each--

Signed and Sealed this

Thirtieth Day of May 1978

[SEAL]

Attest:

RUTH C. MASON
Attesting Officer

LUTRELLE F. PARKER
Acting Commissioner of Patents and Trademarks